US006968792B2

(12) United States Patent
Hori

(10) Patent No.: US 6,968,792 B2
(45) Date of Patent: Nov. 29, 2005

(54) EMBROIDERY FRAME

(75) Inventor: Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/078,482

(22) Filed: Mar. 14, 2005

(65) Prior Publication Data

US 2005/0229830 A1 Oct. 20, 2005

(30) Foreign Application Priority Data

Mar. 30, 2004 (JP) ..... 2004-099589

(51) Int. Cl.[7] ..... D05C 9/04; D06C 3/08
(52) U.S. Cl. ..... 112/103; 38/102.2
(58) Field of Search ..... 112/103, 119, 470.14, 112/475.18; 38/102, 102.2; 69/19.3; 101/127.1; 160/371, 380; 223/61; 24/496, 569

(56) References Cited

U.S. PATENT DOCUMENTS 586,947 A * 7/1897 Bucklin ..... 38/102.2
644,597 A * 3/1900 Guyer et al. ..... 38/102.2
1,249,057 A * 12/1917 Finleu ..... 38/102.2
2,453,492 A * 11/1948 Carter ..... 24/270
5,018,460 A * 5/1991 Schilling et al. ..... 112/103
5,655,469 A 8/1997 Herbach et al.
6,760,985 B2 * 7/2004 Wilson ..... 38/102.2

FOREIGN PATENT DOCUMENTS

JP A-2002-315982 10/2002

* cited by examiner

*Primary Examiner*—Ismael Izaguirre
(74) *Attorney, Agent, or Firm*—Oliff & Berridge, PLC

(57) ABSTRACT

An embroidery frame includes an outer subframe with a section that breaks continuity, an inner subframe that is snapped inside of the outer subframe to hold a cloth with the outer subframe, a clamp mechanism for clamping the outer subframe against the inner subframe. The clamp mechanism includes a pair of screw attachment sections facing each other at both ends of the continuity-breaking section of the outer frame, an adjustment screw attached across the screw attachment sections for adjusting a space between the screw attachment sections, an operation shaft for rotating the adjustment screw that moves in a range from a first position at which the operation shaft is directed in an axial direction same as or different from the adjustment screw, and a second position at which the operation shaft is tilted in a direction increasing a space with the outer subframe, and a coupling mechanism for coupling together the operation shaft and the adjustment screw, and transferring a torque of the operation shaft to the adjustment screw.

30 Claims, 22 Drawing Sheets

EMBROIDERY FRAME

BACKGROUND OF THE INVENTION

1. Field of the Invention

The present invention relates to an embroidery frame of a type firmly holding a cloth between outer and inner subframes.

2. Description of the Related Art

In an embroidery sewing machine of a general type, a frame drive mechanism is driven to move a cloth-holding embroidery frame in X (right-and-left) and Y (back-and-forth) directions, respectively, so that any desired pattern is embroidered onto the cloth.

An exemplary embroidery frame for use with an embroidery sewing machine is found in JP-A-2002-315982. This embroidery frame is formed by a continuous-rectangular inner subframe, a rectangular outer subframe with a section that breaks the continuity, and a clamp mechanism for clamping the outer subframe against the inner subframe. With such a structure, the clamp mechanism includes two protrusion parts, and a screw member. The protrusion parts are respectively located at both sides of the continuity-breaking section of the outer subframe so as to face each other. The screw member is passed through a screw pass-through hole that is formed to the protrusion parts. To fix a cloth to such an embroidery frame, a user places the cloth between the inner and outer subframes of the embroidery frame. The user then uses his/her fingers to rotate an operation section of the screw member that is passed through the screw pass-through hole provided to the two protrusion parts of the outer subframe. Through rotation as such, the outer subframe is clamped against the inner subframe so that the cloth is firmly held thereby.

The problem with such an embroidery frame of JP-A-2002-315982 is that there is no enough space between the outer subframe and the operation section of the screw member. This is due to the placement structure of the screw member being parallel to the linear portion of the rectangular outer subframe. The outer subframe thus becomes an obstacle for the user to pinch the operation section between the thumb and fingertips, resulting in poor workability of the operation section in terms of rotation. This thus requires extra force to clamp the outer subframe against the inner subframe, especially enormous efforts to women who are the main users of the embroidery sewing machine.

When the user wants to fix a cloth to an embroidery frame on a table or others, such a placement structure of the screw member being parallel to the linear portion of the rectangular outer subframe causes another problem of limited accessibility for the space between the table and the operation section of the screw member provided to the embroidery frame. The upper surface of the table becomes also an obstacle for the user to rotate the operation section similarly to the above, and thus the user may bother to move the sewing machine to the position where the operation section protrudes outward from the table corner for clamping of the outer subframe. As such, it is difficult to increase the operation efficiency.

SUMMARY OF THE INVENTION

In consideration of the above problems, an object of the present invention is to provide an embroidery frame that is designed with the aim of achieving better workability on clamping of outer subframe with ease and efficiency. Another object of the present invention is to provide an embroidery frame in which a clamp mechanism is no more an obstacle when the embroidery frame is attached to an embroidery sewing machine or during embroidery work.

In order to achieve the above objects, the present invention is directed to an embroidery frame that includes: an outer subframe with a section that breaks continuity; an inner subframe that is snapped inside of the outer subframe to hold a cloth with the outer subframe; a clamp mechanism for clamping the outer subframe against the inner subframe. In such an embroidery frame, the clamp mechanism includes a pair of screw attachment sections facing each other at both ends of the continuity-breaking section of the outer frame, an adjustment screw that is attached across the screw attachment sections for adjusting a space between the screw attachment sections, an operation shaft for rotating the adjustment screw that moves in a range from a first position at which the operation shaft is directed in an axial direction same as or different from the adjustment screw, and a second position at which the operation shaft is tilted in a direction increasing a space with the outer subframe, and a coupling mechanism for coupling together the operation shaft and the adjustment screw, and transferring a torque of the operation shaft to the adjustment screw.

With the above structure, the operation shaft can move freely in a range between the first position at which the operation shaft is directed in an axial direction same as or different from the adjustment screw, and the second position at which the operation shaft is tilted in a direction increasing the space with the outer subframe. Accordingly, to clamp the outer subframe, a user may moves the operation shaft to the position where the operation shaft does not get in the way for the outer subframe, e.g., second position, and then rotates the operation shaft to go through the clamping operation (fixing a cloth). This allows clamping of the outer subframe with ease and efficiency. Alternatively, the operation shaft may be moved to any arbitrary position between the first and second positions for operation. On the other hand, after completion of clamping, when attaching the embroidery frame to an embroidery sewing machine or working on embroidery sewing, the user moves the operation shaft back to the first position. This prevents the operation shaft from protruding that much outside of the outer subframe, and thus the operation shaft is no more an obstacle.

Accordingly, with such an embroidery frame, the user can clamp the outer subframe with ease and efficiency, and finds it no obstacle for attachment to an embroidery sewing machine, or for embroidery sewing.

In order to achieve the above objects, the present invention is also directed to an embroidery frame for holding a cloth, including: an outer subframe with a section that breaks continuity; an inner subframe that is snapped inside of the outer subframe to hold a cloth with the outer subframe; a clamp mechanism for clamping the outer subframe against the inner subframe. In such an embroidery frame, the clamp mechanism includes a pair of screw attachment sections facing each other at both ends of the continuity-breaking section of the outer frame, an adjustment screw that is attached across the screw attachment sections for adjusting a space between the screw attachment sections, an operation shaft for rotating the adjustment screw that is so provided that an amplitude between the axial center thereof and the axial center of the adjustment screw shows a predetermined angle, and a coupling mechanism for coupling together the operation shaft and the adjustment screw, and transferring a torque of the operation shaft to the adjustment screw.

With such a structure, the operation shaft is fixed at the position where the amplitude between the axial center thereof and the axial center of the adjustment screw shows a predetermined value. At the position, the torque coming from the operation shaft is transferred to the adjustment screw so that the outer subframe can be clamped. Accordingly, the user can clamp the outer subframe of the embroidery frame at the position where the operation shaft does not get in the way for the outer subframe. At this time, the torque provided by the operation shaft rotates the adjustment screw so that the outer subframe can be clamped.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

In the below, a first embodiment of the present invention is described by referring to FIGS. 1 to 15.

Figure 1:
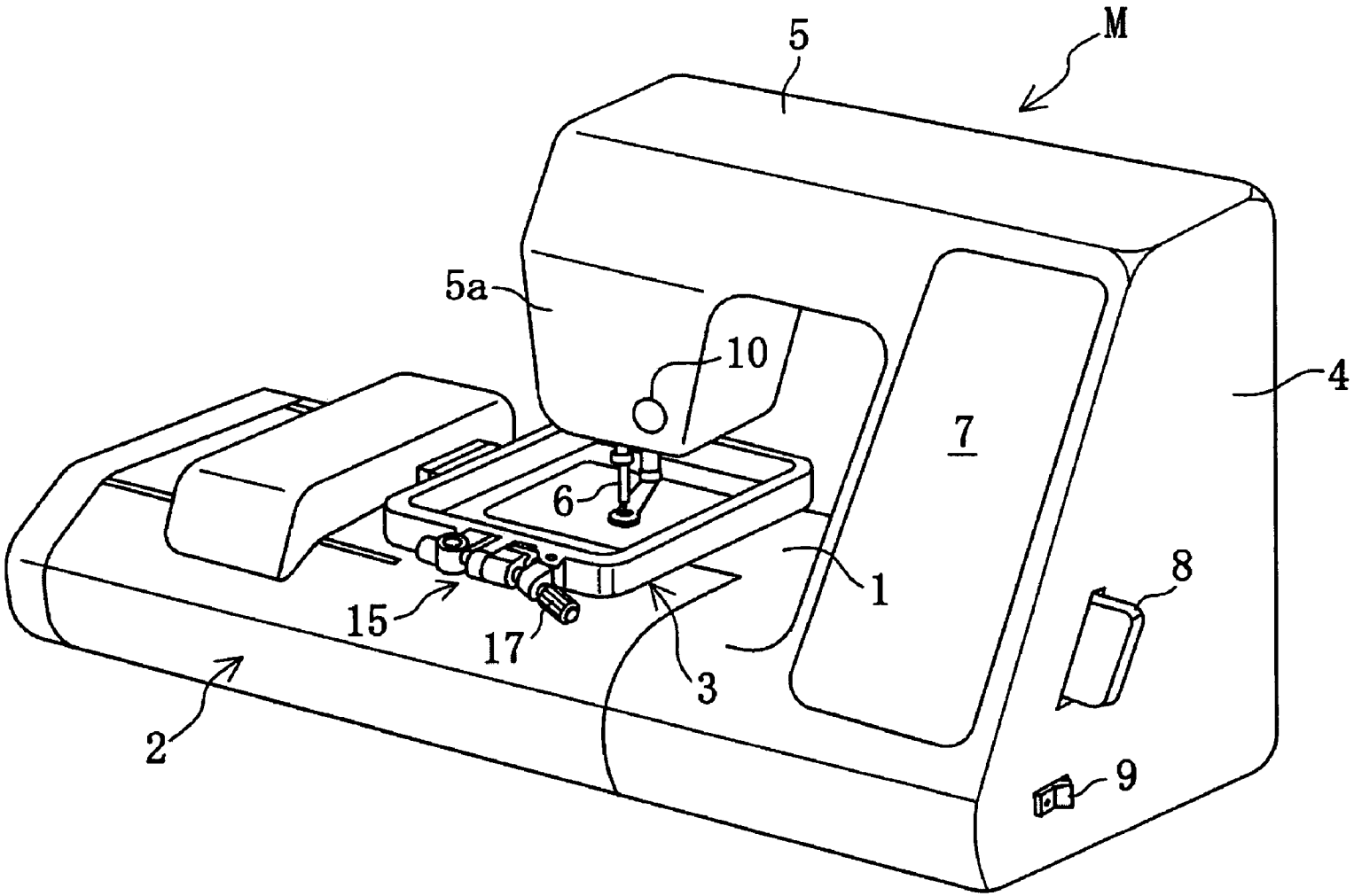
FIG. 1 is a perspective view of an embroidery sewing machine of a first embodiment of the present invention.

As shown in FIG. 1, an embroidery sewing machine M includes an embroidery frame moving mechanism 2 that is detachable/attachable from/to a bed section 1. This embroidery frame moving mechanism 2 is driven to move a cloth-holding embroidery frame 3 fixed with a cloth to be embroidered in X (right-and-left) and Y (back-and-forth) directions, respectively, for embroidery work with the embroidery sewing machine M.

The embroidery sewing machine M has the main body, including the bed section 1, a leg section 4, and an arm section 5. The arm section 5 includes a main shaft, and a needle rod 6. The main shaft is driven by a sewing machine motor, whereby the needle rod 6 reciprocates in the vertical direction. The arm section 5 also carries a needle control mechanism that is to be driven by a needle control pulse motor, which controllably drives the needle rod 6 in the direction orthogonal to the cloth feeding direction. The bed section 1 has a lower shaft that is coupled to the main shaft to move together. The bed section 1 also carries mechanisms all driven by the lower shaft, i.e., mechanisms for rotating a thread loop capturing hook, moving back and forth feed teeth, and moving up and down the feed teeth. The feed teeth back-and-forth mechanism is associatively linked with a mechanism for adjusting the feeding amount, which is driven by a pulse motor provided for the purpose. The arm section 5 is provided with a mechanism for unreeling an upper thread, which is driven by a pulse motor provided for the purpose.

To the front part of the leg section 4, provided is a liquid crystal display (LCD) 7, which displays images in color using three filters of R (red), G (green), and B (blue). This liquid crystal display 7 has a touch panel including various command keys and setting keys, i.e., a user touches any specific command key displayed on the liquid crystal display 7 to issue a command to a controller in change of sewing work, and touches any specific setting key to make a setting.

The leg section 4 is provided with a card connector to establish a detachable connection with an external ROM card 8 storing pattern display data, pattern embroidery data, or others of various embroidery patterns. The leg section 4 is provided with a power switch 9 at the lower side of the card connector. A head portion 5*a* of the arm section 5 is provided with a start/stop switch 10.

Described next is the embroidery frame 3.

Figure 2:
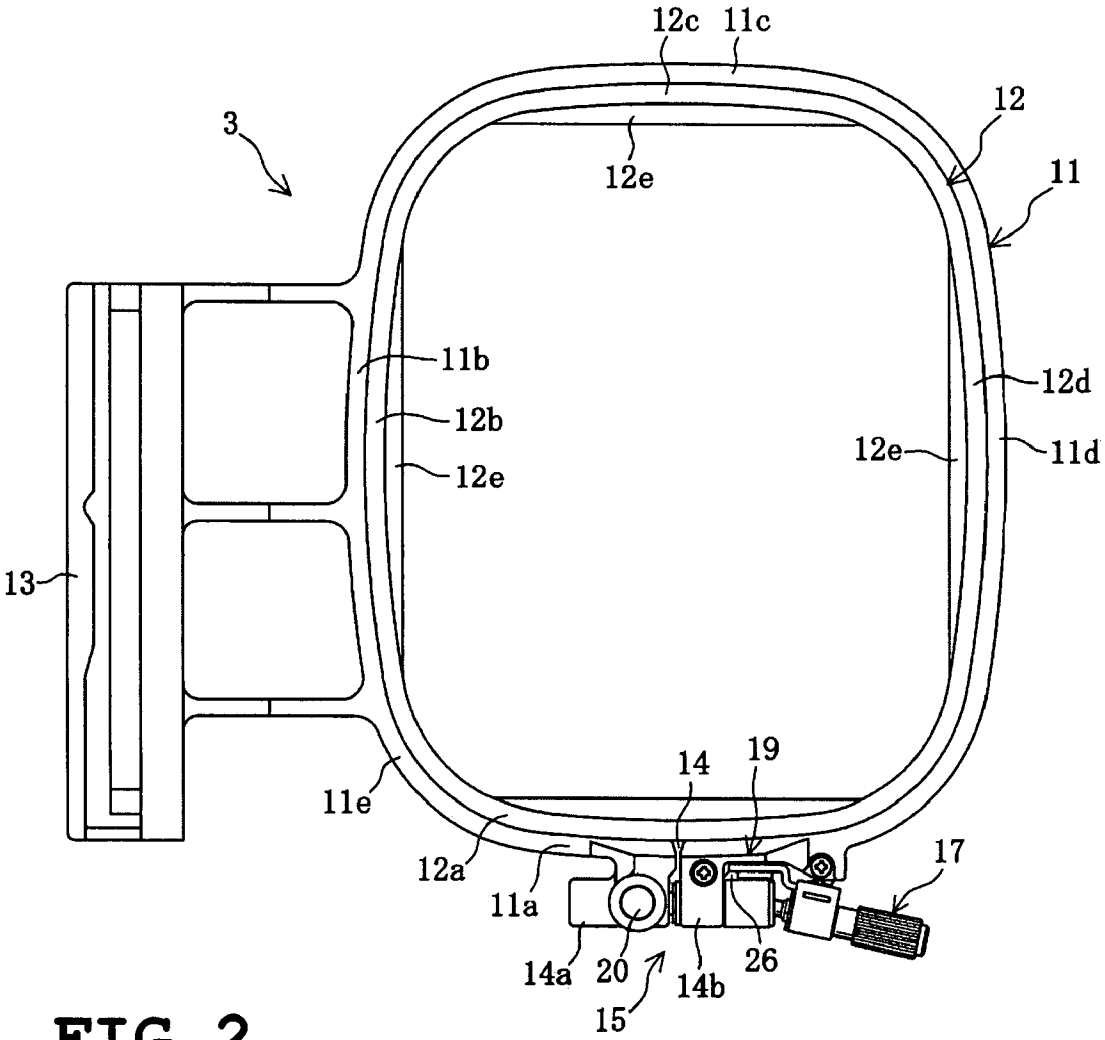
FIG. 2 is a top view of an embroidery frame.

As shown in FIG. 2, the embroidery frame 3 includes outer and inner subframes 11 and 12, both of which are almost rectangular when viewed from the top. The outer subframe 11 is provided with 4outer subframe sides 11*a* to 11*d* locating inside of the horizontal surface, and corner sections 11*e* each locating between any two adjacent sides of the outer subframe sides 11*a* to 11*d*. The outer subframe sides 11*a* to 11*d* are slightly curved but substantially straight, and the corner sections 11*e* are curved. In this example, the substantially-straight outer subframe sides 11*a* to 11*d* are referred to as straight sections with respect to the curved corner sections 11*e*. The outer subframe side 11*b* is provided with an attachment section 13 that is coupled to a drive output section of the embroidery frame moving mechanism 2. The outer subframe side 11*a* has a section 14 that is located at the center in the length direction and breaks the continuity. This continuity-breaking section 14 is provided with a clamp mechanism 15 for clamping the outer subframe 11 against the inner subframe 12.

Similarly to the outer subframe 12, the inner subframe 12 has the shape of substantially rectangular, including 4 inner subframe sides 12*a* to 12*d* locating inside of the horizontal surface, and curved corner sections each locating between any two adjacent sides of the inner subframe sides 12*a* to 12*d*. The inner subframe sides 12*a* to 12*d* are each provided with a rib 12*e* overhanging from their inner peripheral edges. Such a rib 12*e* is provided for reinforcement of the inner subframe 12, and helps both the inner and outer subframes 11 and 12 hold a cloth so that the cloth is well stretched.

Referring to FIGS. 3 to 9, described next is the clamp mechanism 15 for clamping the continuity-breaking section 14 of the outer subframe 11.

Figure 3:
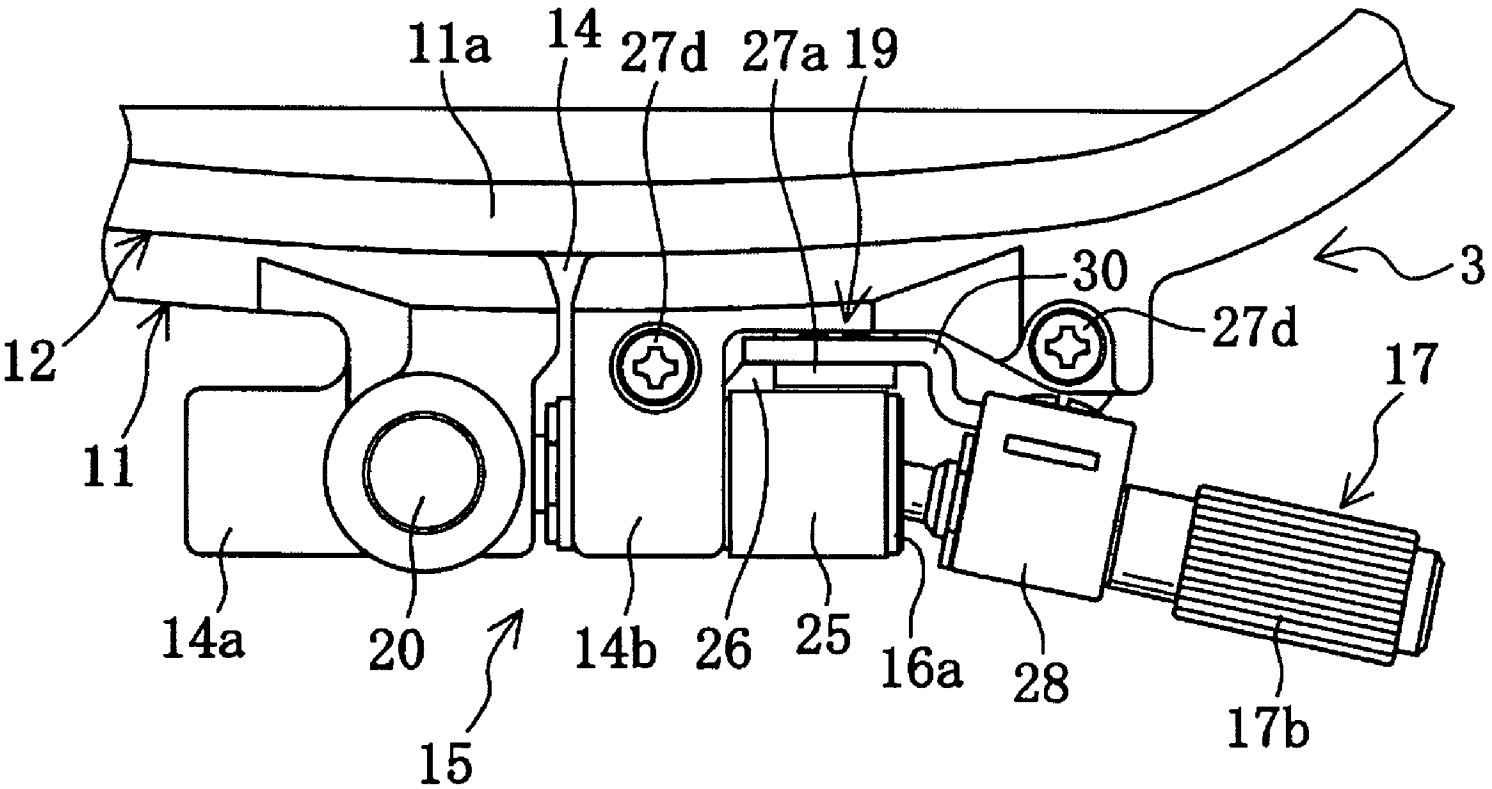
FIG. 3 is a top view of main components and a clamp mechanism (with operation shaft at a first position) of an outer subframe.
Figure 4:
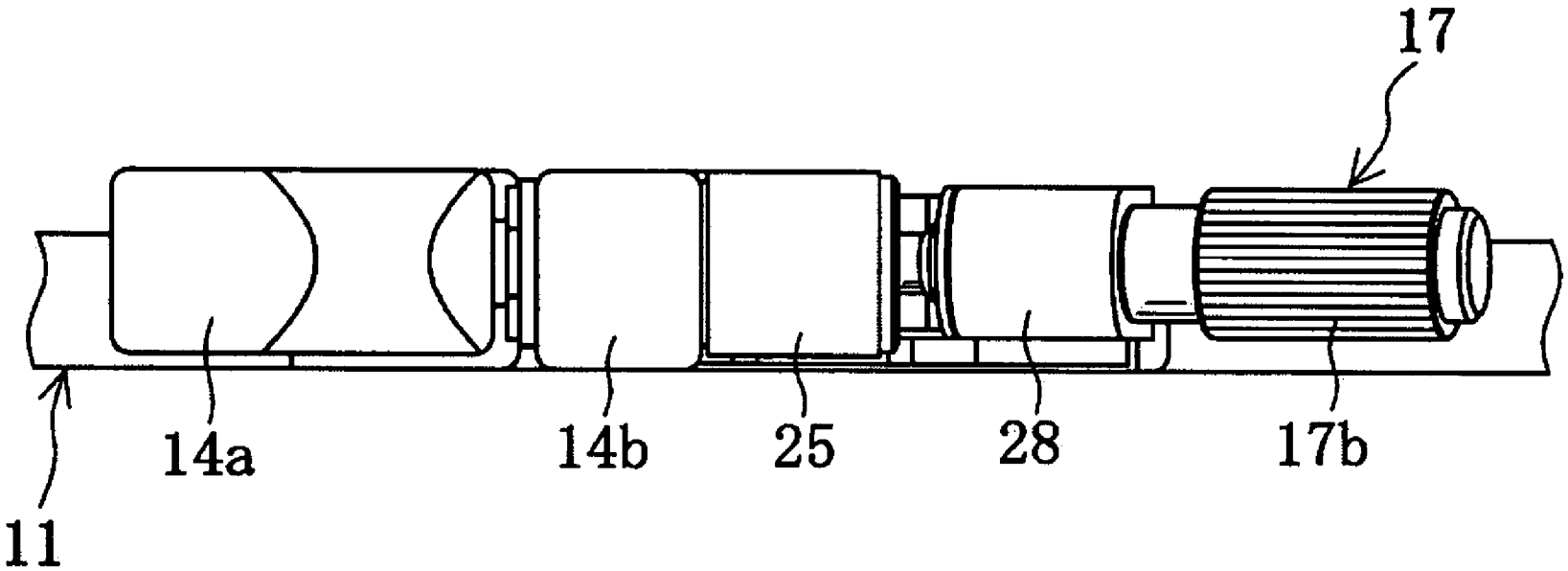
FIG. 4 is a front view of main components and the clamp mechanism (with operation shaft at the first position) of the outer subframe.

As shown in FIG. 3, a pair of screw attachment sections 14*a* and 14*b* are provided to the straight section 11*a* of the outer subframe 11. More in detail, the pair of screw attachment sections 14*a* and 14*b* are so formed as to protrude outwardly from both sides of the continuity-breaking section 14 of the outer subframe side 11*a*, and to oppose to each other. The screw attachment section 14*a* has the length about twice as long as the screw attachment section 14*b*.

Figure 5:
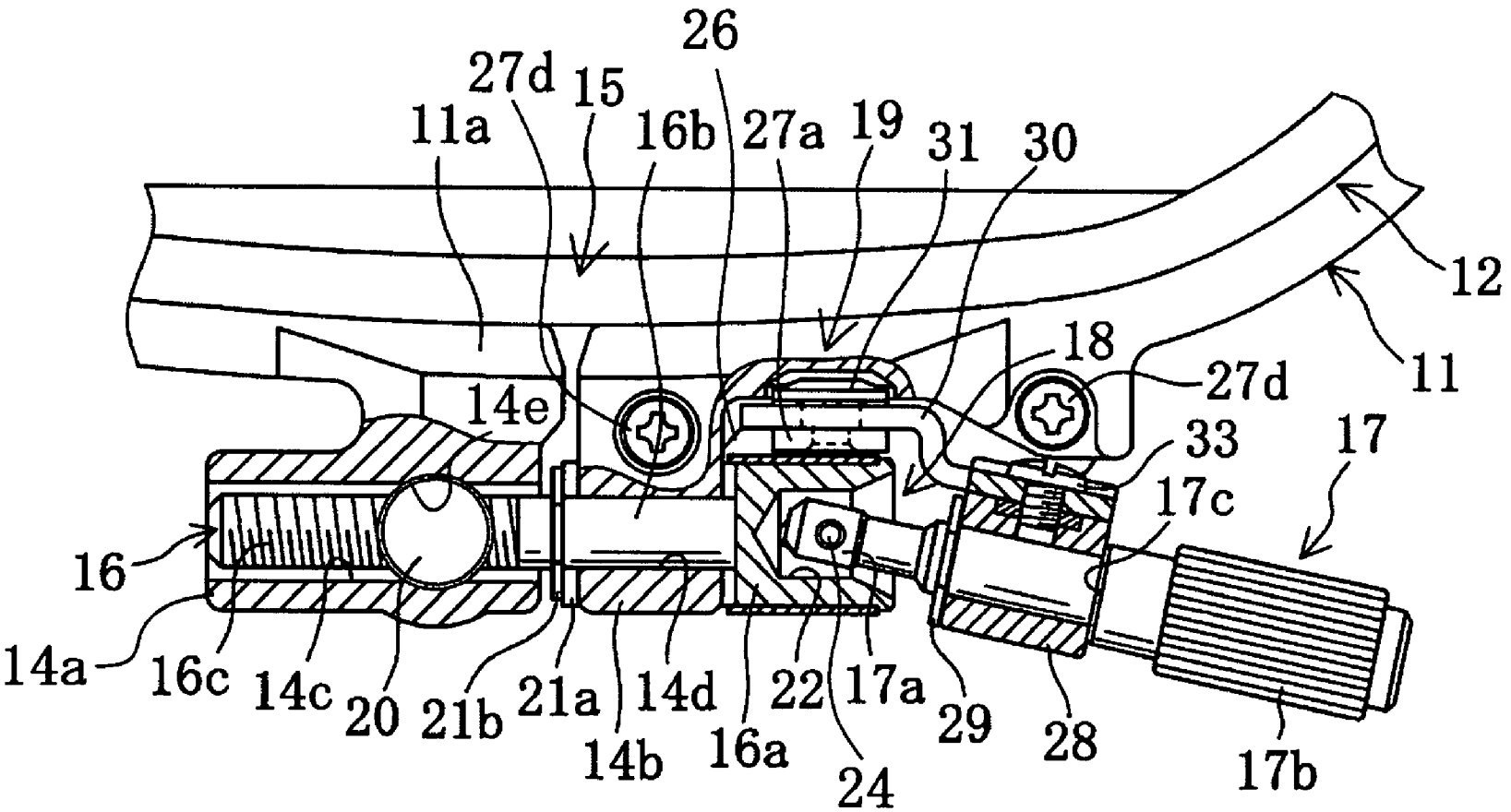
FIG. 5 is a horizontal-partially-cutaway top view of the main components and the clamp mechanism of the outer subframe.

As shown in FIG. 5, the screw attachment sections 14*a* and 14 bare formed with pass-through holes 14*c* and 14*d*, respectively, to be parallel and horizontal to the outer subframe side 11*a*. Into these pass-through holes 14*c* and 14*d*, an adjustment screw 16 is inserted with play. A cylindrical hole 14*e* is formed in the vertical direction of the screw attachment section 14*a*, and attached with a cylindrical nut 20 that is formed across the pass-through hole 14*c*. At the side of the screw attachment section 14*b* opposite to the screw attachment sections 14*a*, formed is a concave section 26 (refer to FIG. 3) with an inverted-L-shaped wall plane carrying therein a head portion 16*a* of the adjustment screw 16 or others.

Figure 6:
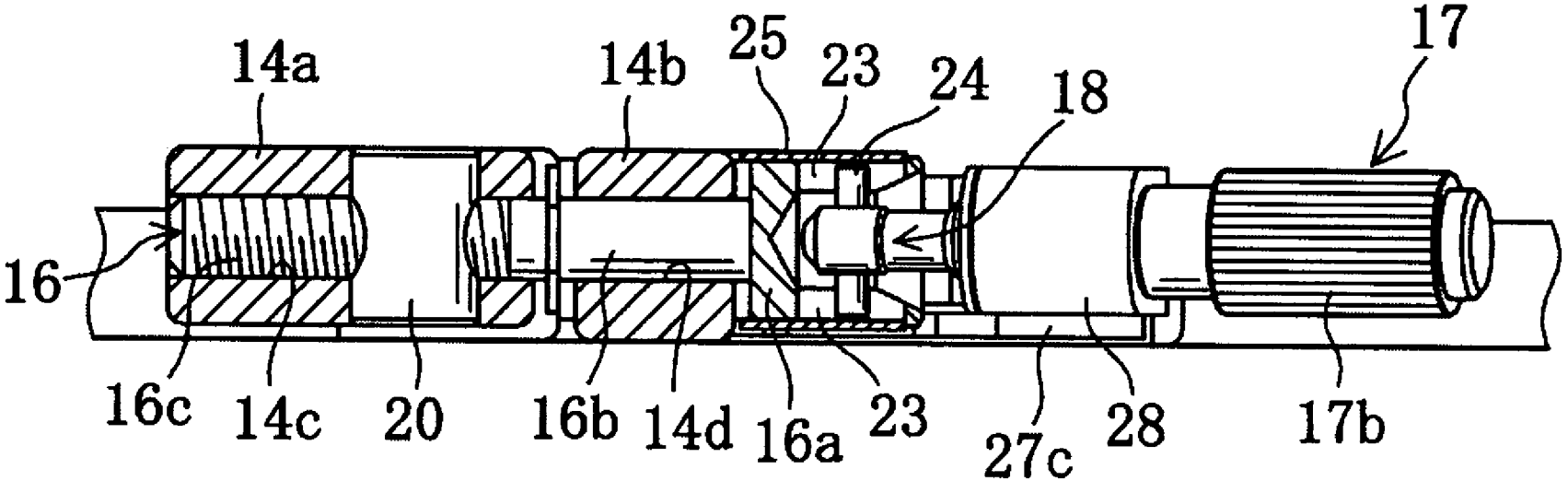
FIG. 6 is a vertical-partially-cutaway front view of the main components and the clamp mechanism of the outer subframe.
Figure 7:
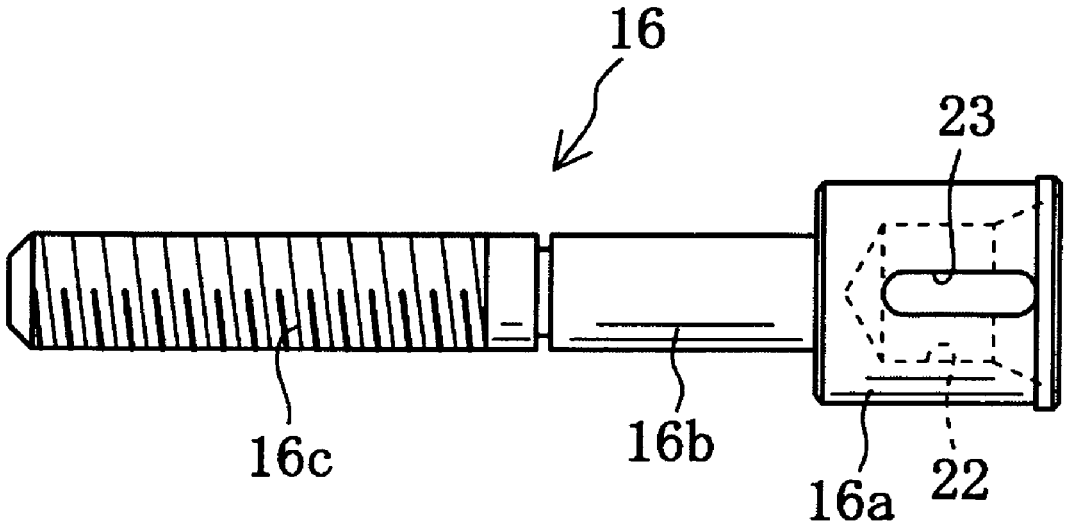
FIG. 7 is a top view of an adjustment screw.
Figure 8:
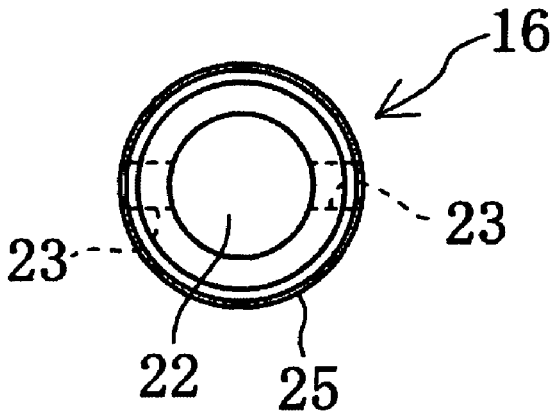
FIG. 8 is a right side view of the adjustment screw.

As shown in FIGS. 5 and 6, the adjustment screw 16 is formed by the head portion 16*a*, a body portion 16*b*, and a screw portion 16*c*, in order of right to left in FIG. 5, all of which are parallel to the outer subframe side 11*a*. The head portion 16*a* is circular-rod-shaped with a large diameter, and placed in the concave section 26. The body portion 16*b* is inserted into the pass-through hole 14*d*, and is rotatably supported to slide in contact with the hole 14*d*. In the body portion 16*b*, the part locating between the screw attachment sections 14*a* and 14*b* is attached with a washer 21*a* and a snap ring 21*b*. The screw portion 16*c* is inserted into the pass-through hole 14*c* with play so as to be screwed into the nut 20. When the adjustment screw 16 is rotated in the screw-clamping direction, i.e., rotated right, clamping is so applied that the continuity-breaking section 14 is narrowed. On the other hand, when the adjustment screw 16 is rotated in the direction opposite to the screw-clamping direction, i.e., rotated left, clamping is so released that the continuity-breaking section 14 is widened.

Still referring to FIGS. 5 and 6, described now is a coupling mechanism 18 for transferring a torque of an operation shaft 17 to the adjustment screw 16.

The head portion 16*a* of the adjustment screw 16 is formed with a coupling hole 22, the right end side of which is open. This open right end side of the coupling hole 22 is formed larger in diameter toward the right. Around the coupling hole 22, a pair of slits 23 are formed along the axial direction of the adjustment screw 16 (refer to FIGS. 7 and 8). A tip end portion 17*a* of the operation shaft 17 is formed smaller than the coupling hole 22, and inserted into the coupling hole 22 with play. Into the tip end portion 17*a*, an engagement pin 24 is inserted orthogonal to the axial center of the operation shaft 17 to slide in contact with the tip end portion 17*a*. The both ends of the engagement pin 24 are engaged with the pair of slits 23 to slide in contact therewith, respectively.

The torque acting on the operation shaft 17 is transferred from the tip end portion 17*a* of the operation shaft 17 to the adjustment screw 16 via the engagement pin 24. The tip end portion 17*a* of the operation shaft 17 is so formed as to freely rotate about the engagement pin 24. More in detail, the tip end portion 17*a* of the operation shaft 17 is so formed as to freely rotate inside of the plane including the engagement pin 24 responsively when the engagement pin 24 moves inside of the slits 23. That is, through combination of movements in the above-described two directions, the coupling mechanism 18 operates similarly to a torque-transferable universal joint with the operation shaft 17 tilted at any arbitrary angle. Herein, the head portion 16*a* of the adjustment screw 16 is attached with a cover sleeve 25 made of synthetic resin, and the cover sleeve 25 helps the engagement pin 24 not to disengage from the tip end portion 17*a* of the operation shaft 17.

By referring to FIGS. 5, 6, and 9 to 15, described next is a pivotal mechanism 19.

Figure 9:
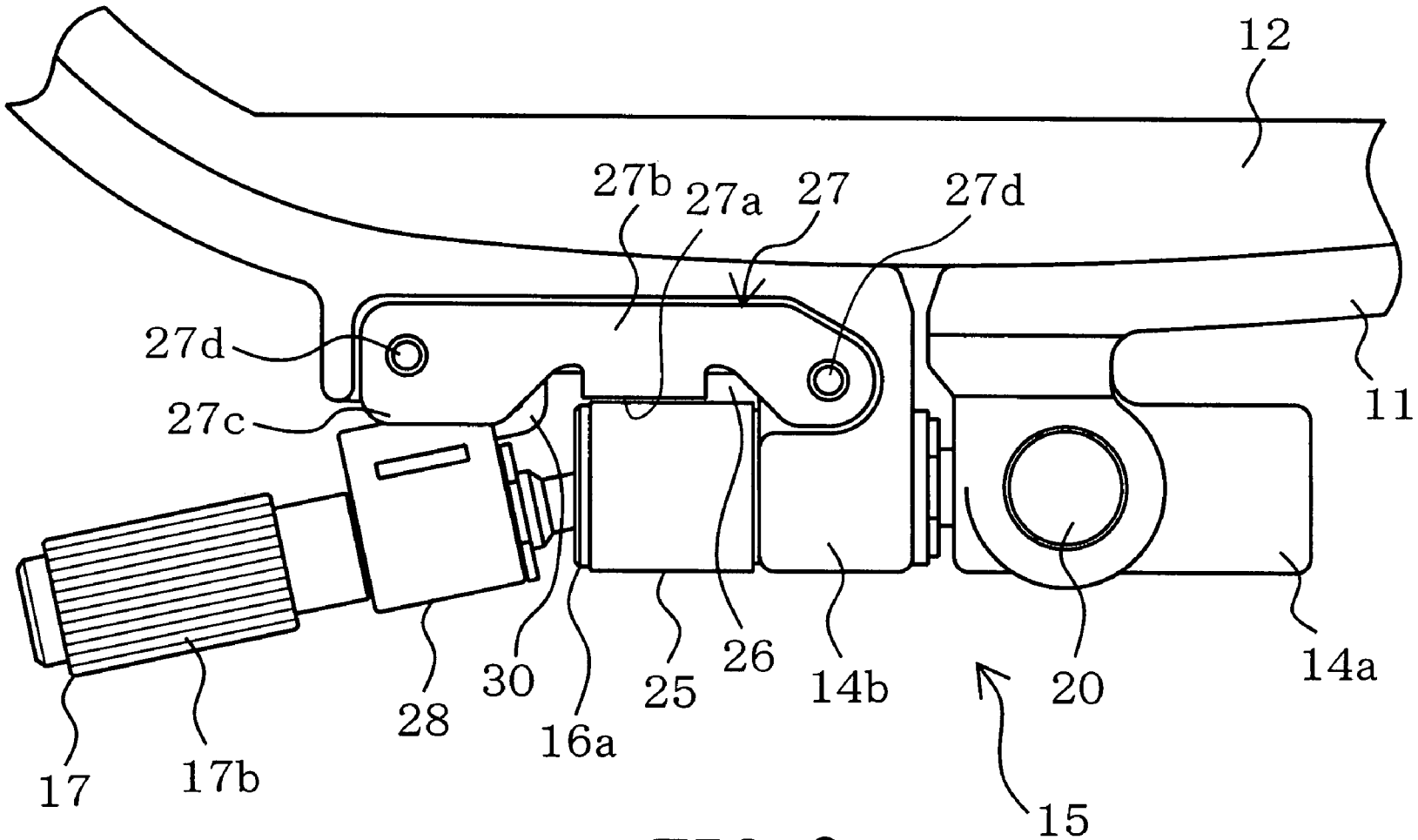
FIG. 9 is a back side view of the main components and the clamp mechanism (with operation shaft at the first position) of the outer subframe.
Figure 10:
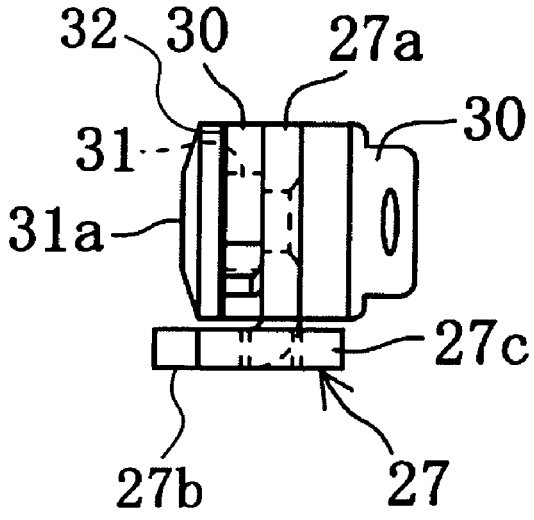
FIG. 10 is a left side view of a pivotal mechanism (with operation shaft at the first position)
Figure 11:
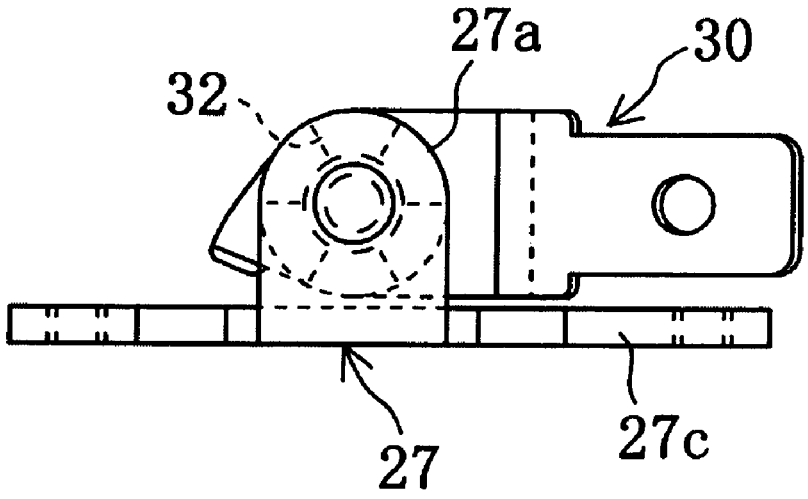
FIG. 11 is a front view of the pivotal mechanism.
Figure 12:
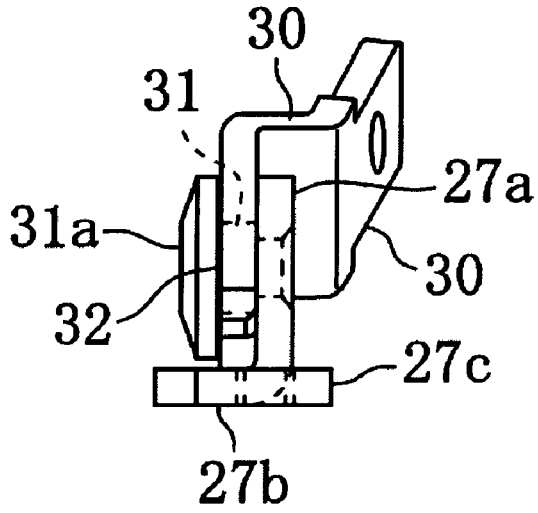
FIG. 12 is a left side view of the pivotal mechanism (with operation shaft at a second position)

As shown in FIGS. 5 and 9, a base portion 27*b* of a pivotal member 27 is placed beneath the outer subframe side 11. To the base portion 27*b* of the pivotal member 27, a pair of screws 27*d* is screwed from the upper surface side of the outer subframe 11.

As shown in FIGS. 10 to 13, the pivotal member 27 includes the base portion 27*b* placed beneath the outer subframe 11, a pivot portion 27*a* standing upright from the base portion 27*b* and facing the concave section 26, and a stopper portion 27*c* (refer to FIG. 9 for details) overhanging from the outer subframe 11 of the base portion 27*b* toward the concave section 26. Herein, the stopper portion 27*c* limits the movement (rotation) range of the operation shaft 17.

As shown in FIG. 5, an operation section 17*b* is formed at the upper end part of the operation shaft 17, and a coupling member 28 made of synthetic resin is installed around at some midpoint of the operation shaft 17. This coupling member 28 is sandwiched between a height-different portion 17*c* and a snap ring 29, both of which are formed to the operation shaft 17. Such a structure helps the operation shaft 17 not to move in the axial direction, and this coupling member 28 supports the operation shaft 17 to freely rotate.

A support arm 30 provided for supporting the operation shaft 17 is made of a metal plate that is substantially in the L-shape when viewed from the top. At some point of the support arm 30, a bending height-different section is formed.

The upper end portion of the support arm 30 is fixed to the surface of the coupling member 28 on the side of the outer subframe 11 by a screw 33. The tip end portion of the support arm 30 is pivotally supported, to freely rotate, by the pivot portion 27*a* of the pivot member 27 using a height-different pin 31. The tip end portion of the support arm 30 is so placed as to be axially parallel to the adjustment screw 16 in the lateral direction when viewed from the top, and axially perpendicular to the adjustment screw 16 in the vertical direction when viewed from the front. The height-different pin 31 is axially orthogonal both to the adjustment screw 16 and the engagement pin 24 of FIG. 5. With such a structure, the operation shaft 17 can rotate freely about the height-different pin 31.

Figure 13:
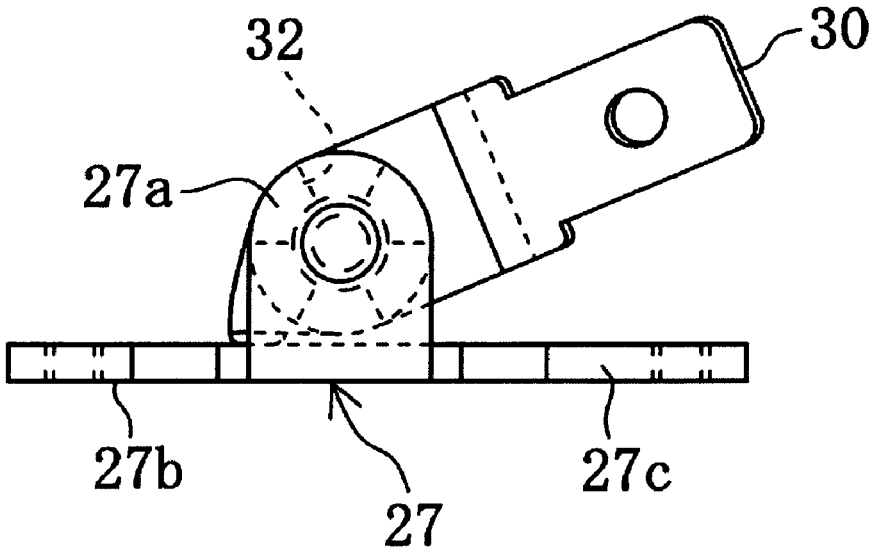
FIG. 13 is another front view of the pivotal mechanism (with operation shaft at the second position)
Figure 14:
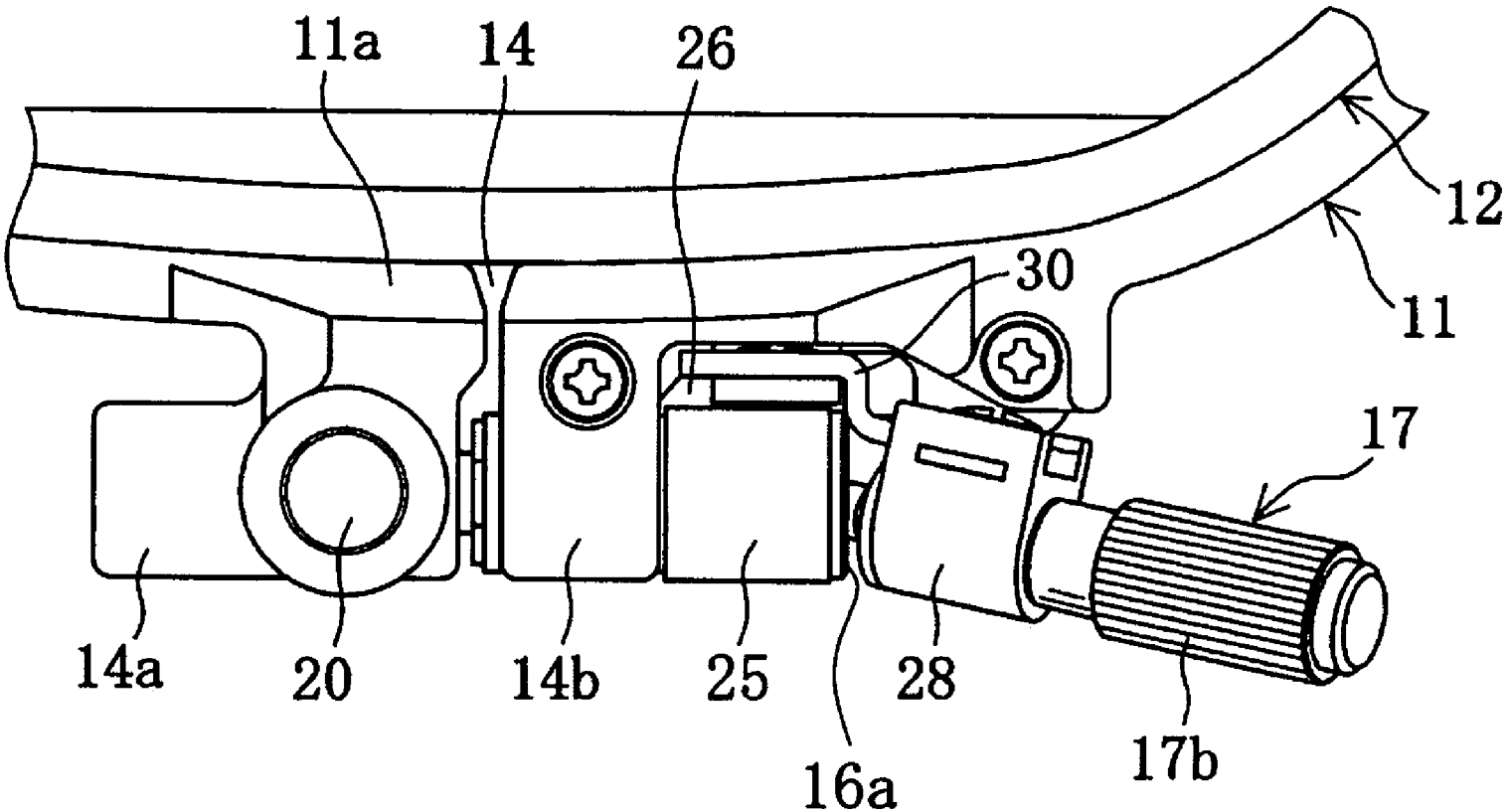
FIG. 14 is a top view of the main components and the clamp mechanism (with operation shaft at the second position) of the outer subframe.
Figure 15:
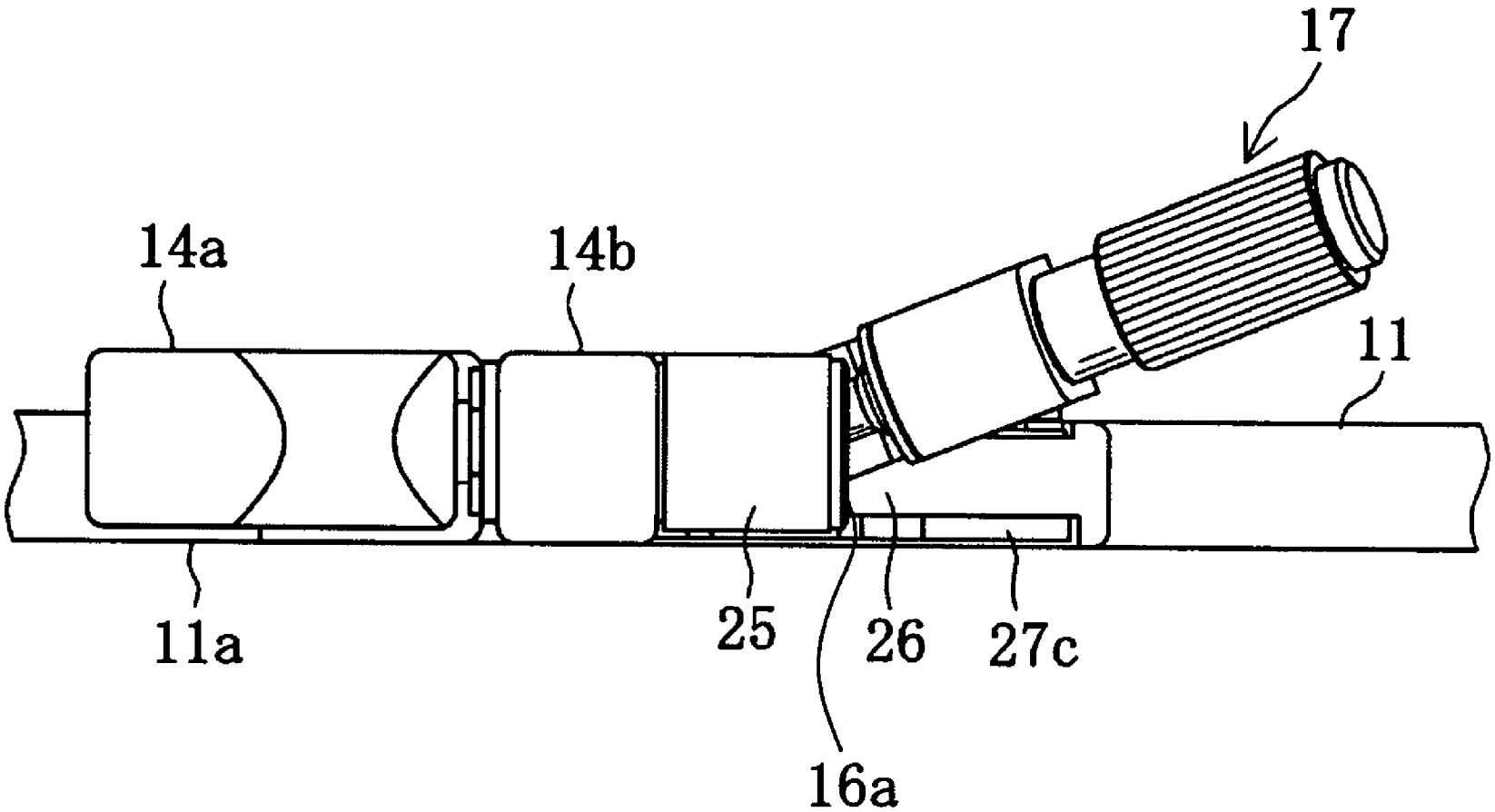
FIG. 15 is a front view of the main components and the clamp mechanism (with operation shaft at the second position) of the outer subframe.
Figure 16:
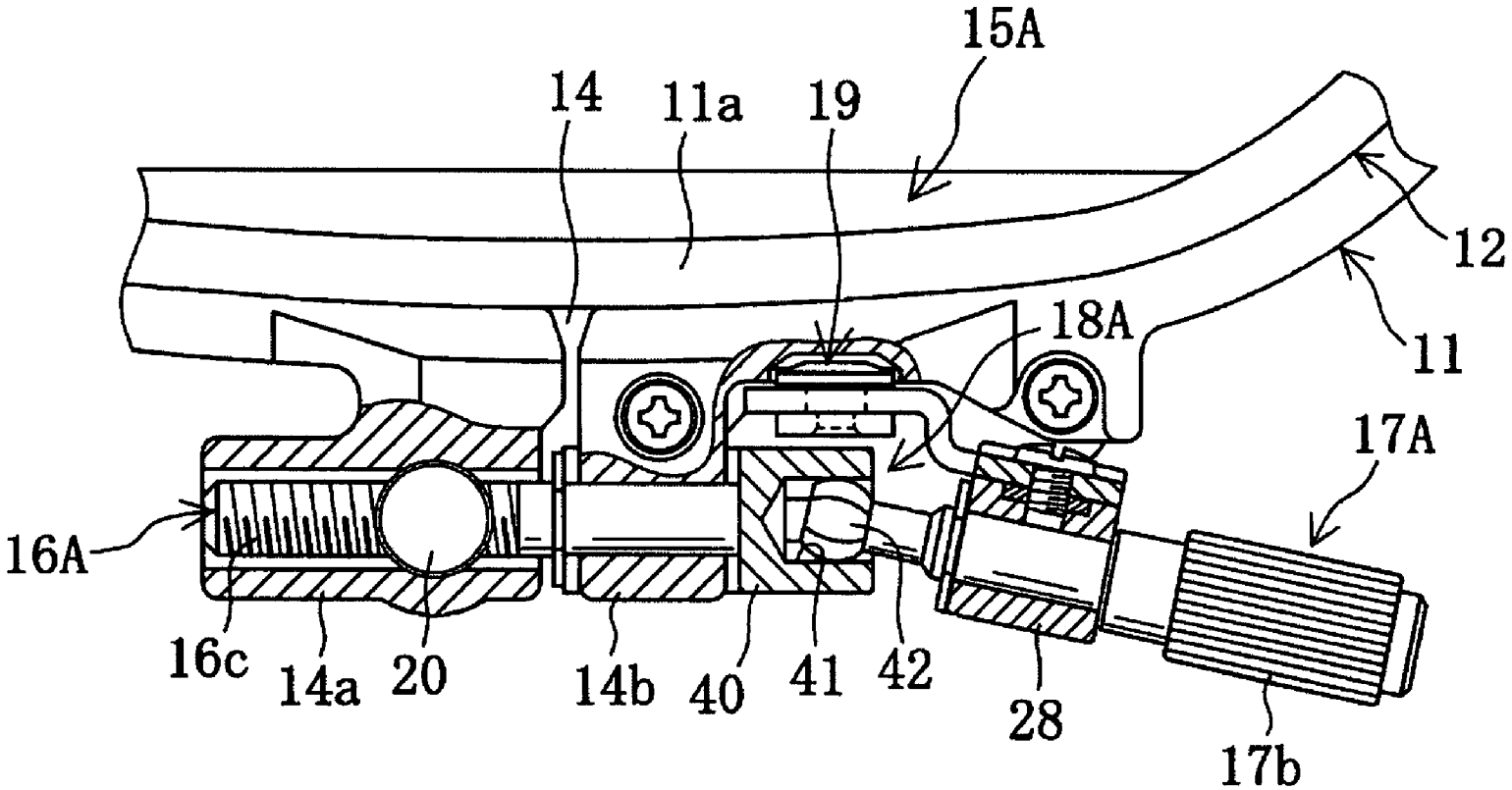
FIG. 16 is a diagram in a second embodiment corresponding to FIG. 5.
Figure 17:
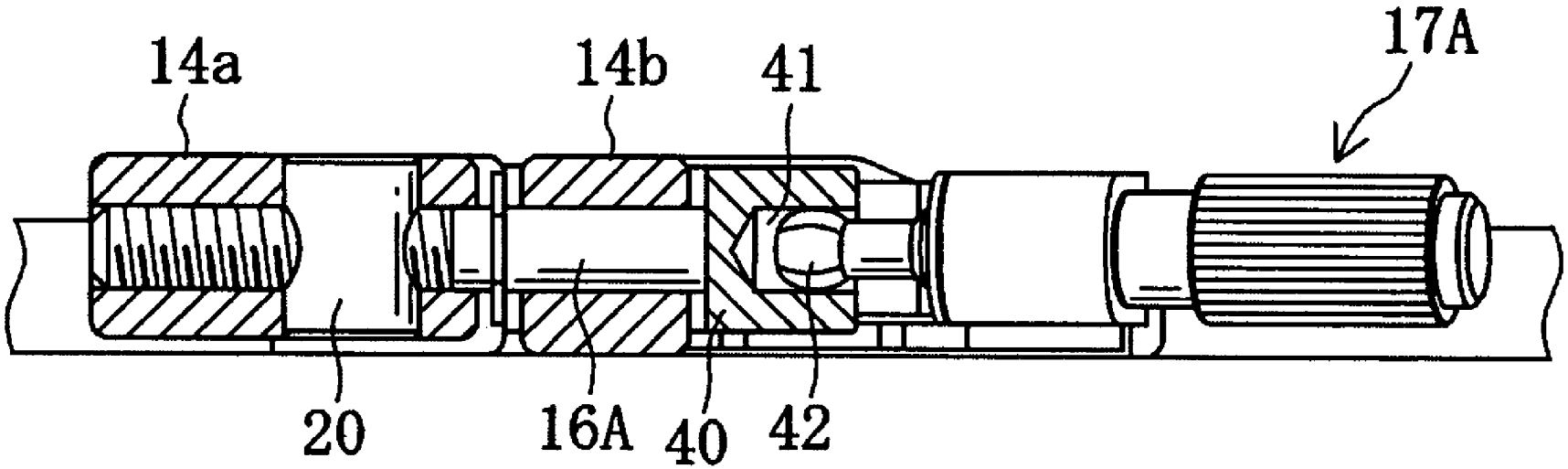
FIG. 17 is a diagram corresponding to FIG. 6.
Figure 18:
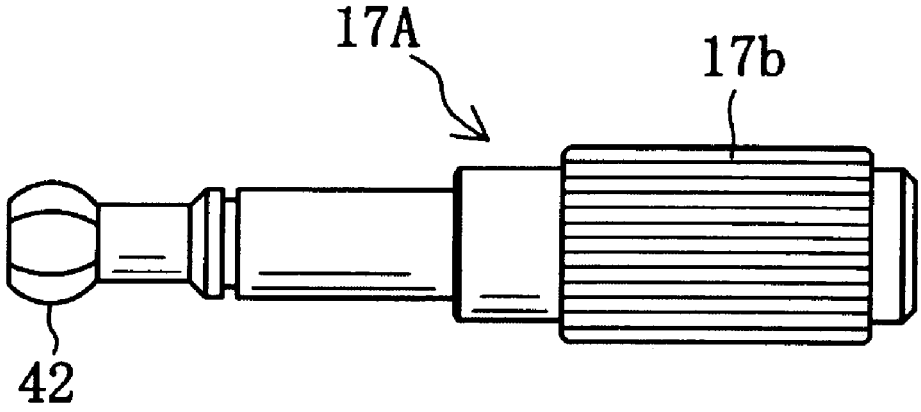
FIG. 18 is a plan view of an operation shaft.

This is the reason why the torque coming from the operation shaft 17 is transferred to the adjustment screw 16 by the coupling mechanism 18. The operation shaft 17 is pivotally supported to the outer subframe 11 by the pivotal mechanism 19 to freely rotate. Accordingly, the operation shaft 17 can move in a range between a first position (initial position) and a second position (in-use position). Specifically, at the first position, as shown in FIGS. 5 and 6, the operation shaft 17 is in the horizontal position parallel to the outer subframe side 11*a* in an axial direction different from the adjustment screw 16. At the second position, as shown in FIGS. 13 and 14, the operation shaft 17 is tilted upward to widen the space with the outer subframe 11, and the space with the horizontal surface (stretched surface of a cloth) including the lower surface of the inner subframe 12.

As shown in FIGS. 10 to 13, a corrugated washer 32 is attached between the head potion 31*a* of the height-different pin 31 and the support arm 30. Through provision of such a corrugated washer 32, the frictional resistance is provided every time the tip end portion of the support arm 30 rotates, and the operation shaft 17 is retained at any arbitrary position between the first and second positions (the first and second positions included). When the operation shaft 17 is at the first position, the stopper portion 27*c* of the pivot member 27 supports the operation shaft 17 from below so that the operation shaft 17 is limited in its movement range. Note here that the head portion 31*a* of the height-different pin 31, the corrugated washer 32, and the pivot portion 27*a* all serve as "latch means", which works to latch the operation shaft 17 at any arbitrary position between the first and second position, or at the second position. The head portion 31*a* of the height-different pin 31, the corrugated washer 32, and the pivot portion 27*a* are all equivalent to "retention member".

Described next is the effects of such an embroidery frame 3.

A user places the outer subframe 11 on a table with a surface directed upward (orientation of FIG. 2). The user then positions a cloth over the outer subframe 11, and positions the inner subframe 12 over the cloth with a surface directed upward (orientation of FIG. 2). The inner subframe 12 is then pushed down to snap it inside of the outer subframe 11 with the cloth therebetween. Thereafter, the user pulls the edge of the cloth to stretch the cloth.

The user then pinches, between his/her thumb and finger tips, the operation section 17*b* of the operation shaft 17 in the clamping mechanism 15 provided to the outer subframe 11, and moves the operation shaft 17 in such a direction that the angle is increased between the axial center of the operation shaft 17 and the cloth surface held by the embroidery frame 3, i.e., upward slanting direction. In this manner, the operation shaft 17 is adjusted in position for ease of operation. When the user rotates the operation section 17*b* of the operation shaft 17 in the clamping direction, i.e., right, to input the torque, the torque is transferred to the adjustment screw 16 via the coupling mechanism 18. In response, the screw attachment sections 14*a* and 14*b* of the outer subframe 11 are so clamped, to the right level, as to bring those closer. The cloth is thus firmly held between the inner side surface of the outer subframe 11 and the outer side surface of the inner subsurface 12.

After completion of clamping as such, the user moves the operation section 17*b* of the operation shaft 17 downward to bring it closer to the cloth surface held by the embroidery frame so that the operation shaft 17 is moved to its initial position at which the operation shaft 17 is axially parallel to the cloth surface. The user then moves the embroidery frame 3 onto the bed section 1 of the embroidery sewing machine M, and attaches the attachment section 13 of the outer subframe 11 to the output section of the embroidery frame moving mechanism 2.

As such, to clamp the space between the pair of screw attachment sections 14*a* and 14*b* provided to the outer subframe 11, the user moves the operation shaft 17 from the first position to the second position, or to any arbitrary position between the first and second positions so as to widen the space between the operation section 17*b* of the operation shaft 17 and the outer subframe 11 or the table. In this manner, the workability on clamping is increased, thereby leading to the better operation efficiency.

Further, to remove the cloth from the outer subframe 11 after embroidery sewing, the user goes through the similar processes to the above. That is, with the operation shaft 17 at the second position, or at any arbitrary position between the first and second positions, the user rotates the operation section 17*b* of the operation shaft 17 in the clamping-release direction, i.e., left, so that the clamping applied by the clamping mechanism 15 is released.

Still further, after clamping of the clamping mechanism 15, the user moves the operation shaft 17 back to the first position, i.e., initial position, and thus the operation shaft 17 is also moved, for retention, to the first position, i.e., initial position, where the operation shaft 17 is axially parallel to the cloth surface or the bed surface of the embroidery sewing machine M. The operation shaft 17 is now ready for embroidery sewing without protruding from the outer subframe 11, and thus the operation shaft 17 is no more an obstacle for embroidery sewing. What is better, for storage of the embroidery frame 3, the operation shaft 17 will be kept out of the way if the user moves the operation shaft 17 at the first position, and it is considered also advantageous in terms of storage.

By referring to FIGS. 16 to 21, described next is a second embodiment of the present invention. Herein, any components similar in structure to those in the first embodiment are provided with the same reference numerals, and only different components will be described below.

Figure 21:
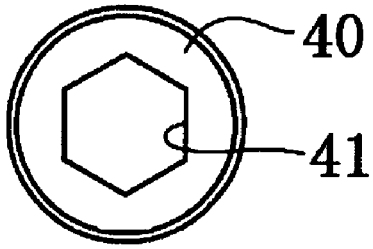
FIG. 21 is a right side view of the adjustment screw.

In the second embodiment, in a clamping mechanism 15A, a coupling mechanism 18A is different from that in the first embodiment for use to couple an operation shaft 17A to an adjustment screw 16A. That is, as shown in FIG. 21, a head portion 40 of the adjustment screw 16A is formed with a hex hole 41 (coupling hole), and at the tip end portion of the operation shaft 17A, formed is a ball-like engagement section 42 that can be snapped into the hex hole 41.

Figure 19:
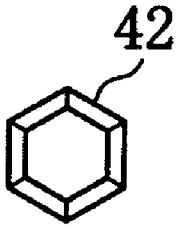
FIG. 19 is a left end side view of the operation shaft.
Figure 20:
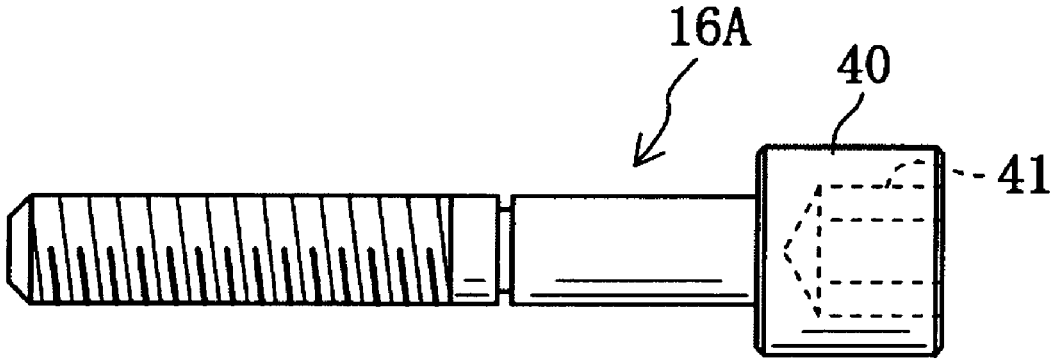
FIG. 20 is a plan view of an adjustment screw.

The engagement section 42 looks like a ball when viewed from the side (refer to FIG. 18), and its cross section cut along the line axially orthogonal to the operation shaft 17A is hexagon (refer to FIG. 19). Accordingly, six corner portions of the engagement section 42 fits in the corner portions of the hex hole 41, and thus the torque can be transferred from the engagement section 42 to the head portion 40 of the adjustment screw 16A. That is, the engagement section 42 and the hex hole 41 serve as a torque-transferable universal joint.

With the operation shaft 17A tilted toward any arbitrary position, the torque coming from the operation shaft 17A is transferred to the adjustment screw 16A. By the user going through the rotation operation for the operation shaft 17A, the adjustment screw 16A is accordingly rotated to clamp or release the clamp mechanism 15A. The remaining components, effects, and advantages are similar to those in the above embodiments.

Figure 22:
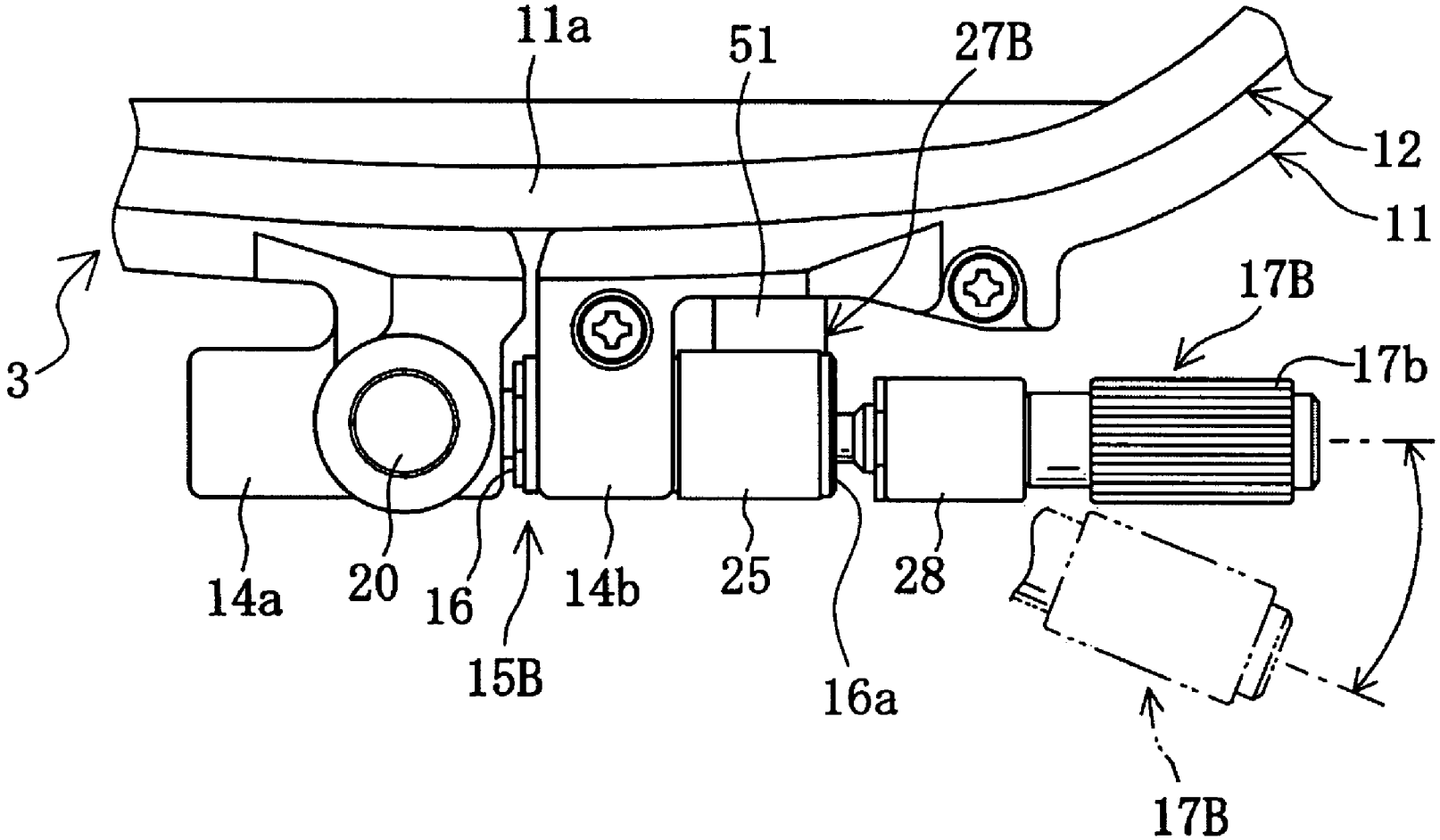
FIG. 22 is a diagram in a third embodiment corresponding to FIG. 3.
Figure 23:
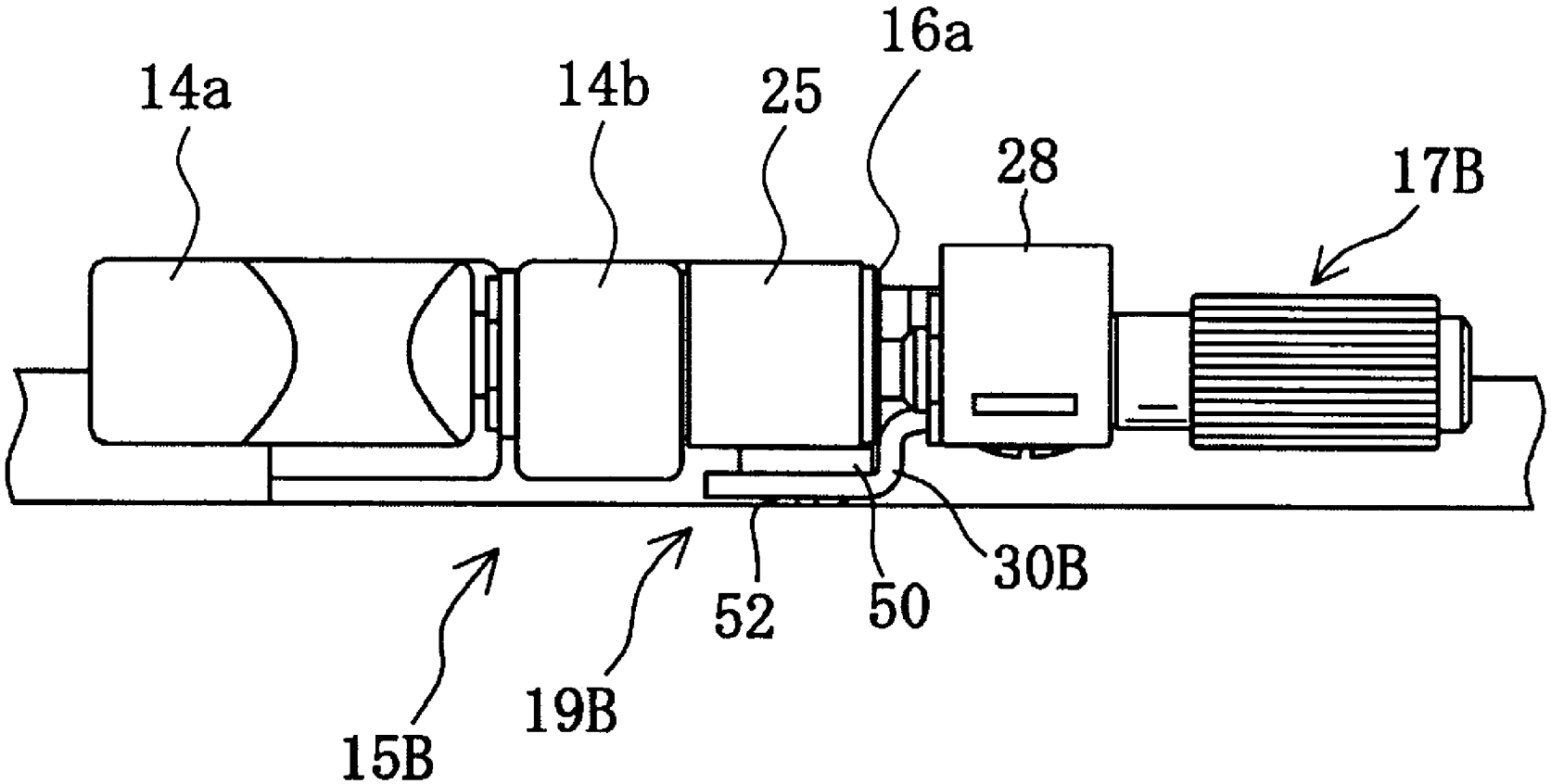
FIG. 23 is a diagram corresponding to FIG. 4.

By referring to FIGS. 22 and 23, described next is a third embodiment of the present invention. Herein, any components similar in structure to those in the above embodiments are provided with the same reference numerals, and only different components will be described below.

In the third embodiment, in a clamping mechanism 15B provided to the outer subframe 11 of the embroidery frame 3, a pivotal mechanism 19B is different for pivotally supporting an operation shaft 17B to freely rotate. More in detail, a base section 51 of a pivot member 27B is formed with a pivot portion 50, which is horizontal to the base section 51 and extended beneath the head portion 16*a* of the adjustment screw 16. To this pivot portion 50, the tip end portion of a support arm 30B for supporting the operation shaft 17B is pivotally supported using a height-different pin (only its head portion 52 is shown). Moreover, between the head portion 52 of the height-different pin and the tip end portion of the support arm 30B, a corrugated washer similar to the corrugated washer 32 is attached. The operation shaft 17B for rotating the adjustment screw 16 can move in a range between a first position (initial position) and a second position (in-use position). Specifically, at the first position, the operation shaft 17B is in the same axial direction as the adjustment screw 16. At the second position, the operation shaft 17B is tilted in the horizontal plane to widen the space (open angle) with the outer subframe side 11*a* of the outer subframe 11. Accordingly, when the user moves the operation shaft 17B to the second position, the space (open angle) between the operation shaft 17B and the outer subframe side 11*a* is widened to a greater degree. Accordingly, this increases the workability of the operation shaft 17B on clamping for the user to rotate the adjustment screw 16, thereby leading to the better operation efficiency. The remaining components, effects, and advantages are similar to those in the above embodiments.

Figure 24:
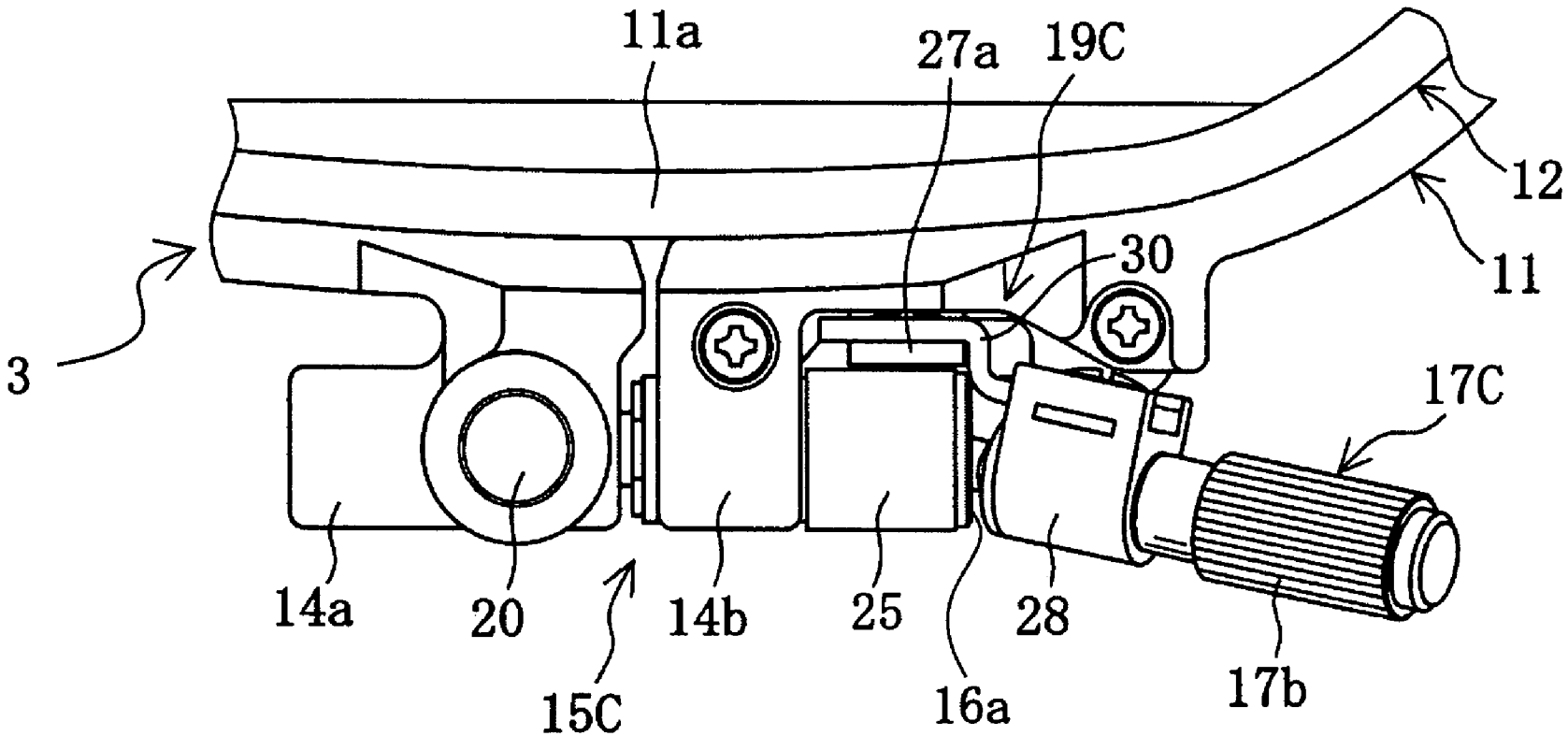
FIG. 24 is a diagram in a fourth embodiment corresponding to FIG. 3.
Figure 25:
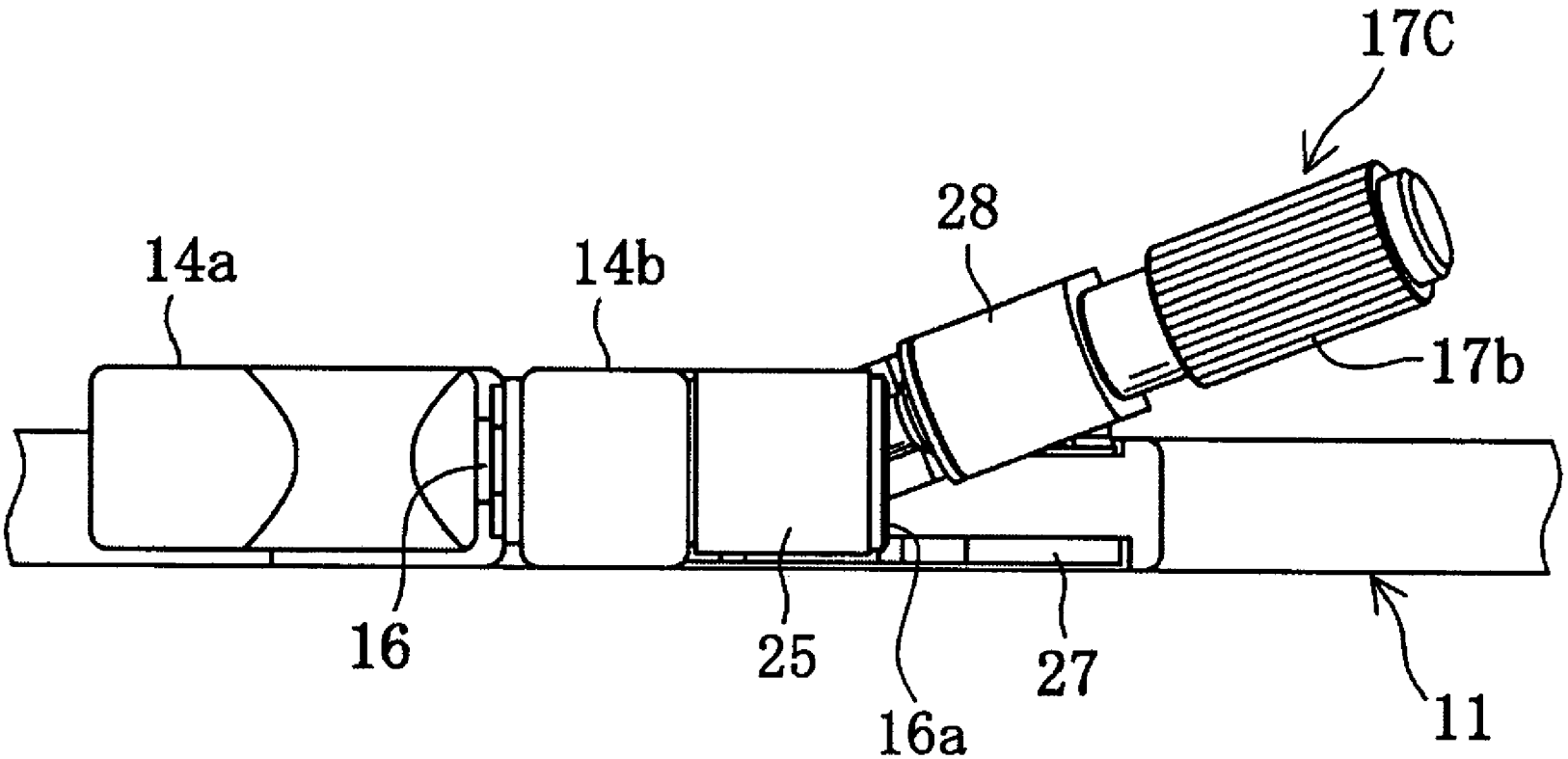
FIG. 25 is a diagram corresponding to FIG. 4.

By referring to FIGS. 24 and 25, described next is a fourth embodiment of the present invention. Herein, any components similar in structure to those in the above embodiments are provided with the same reference numerals, and only different components will be described below.

In a clamping mechanism 15C of the outer subframe 11 of the embroidery frame 3, a pivotal mechanism 19C for pivotally supporting an operation shaft 17C is different. The operation shaft 17C for rotating the adjustment screw 16 is fixed at the position where the angle (equivalent to amplitude) between its axial center and the axial center of the adjustment screw 16 shows a predetermined value. The operation shaft 17C is fixed to the position equivalent to the second position (in-use position) in the first embodiment, and the torque coming to the operation shaft 17C goes to the adjustment screw 16 via the coupling mechanism 18.

With such a structure, in the clamping mechanism 15C of the outer subframe 11, the initial position and the in-use position are the same for the operation shaft 17C, and the operation shaft 17C is fixed at the in-use position that is away from the outer frame 11. Accordingly, the workability on clamping or releasing of the clamping mechanism 15C is increased, thereby leading to the better operation efficiency. The remaining components, effects, and advantages are similar to those in the first embodiment.

A concern here is that, for use with embroidery sewing, the operation section 17*b* of the operation shaft 17C may get in the way. Therefore, as an alternative structure, the operation section 17*b* of the operation shaft 17C may be formed detachable, and during embroidery sewing, the operation section 17*b* may be removed.

Figure 26:
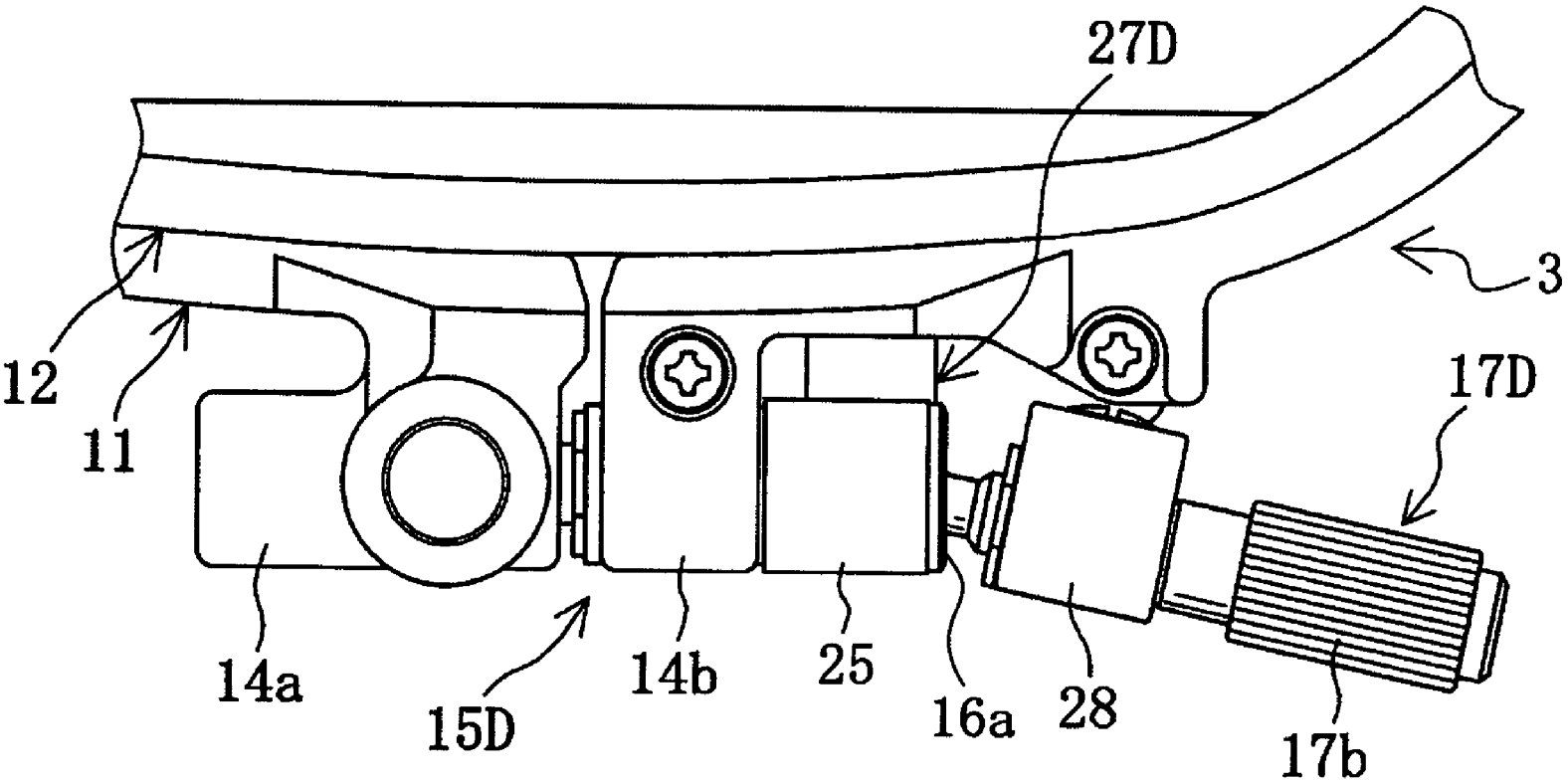
FIG. 26 is a diagram in a fifth embodiment corresponding to FIG. 3.
Figure 27:
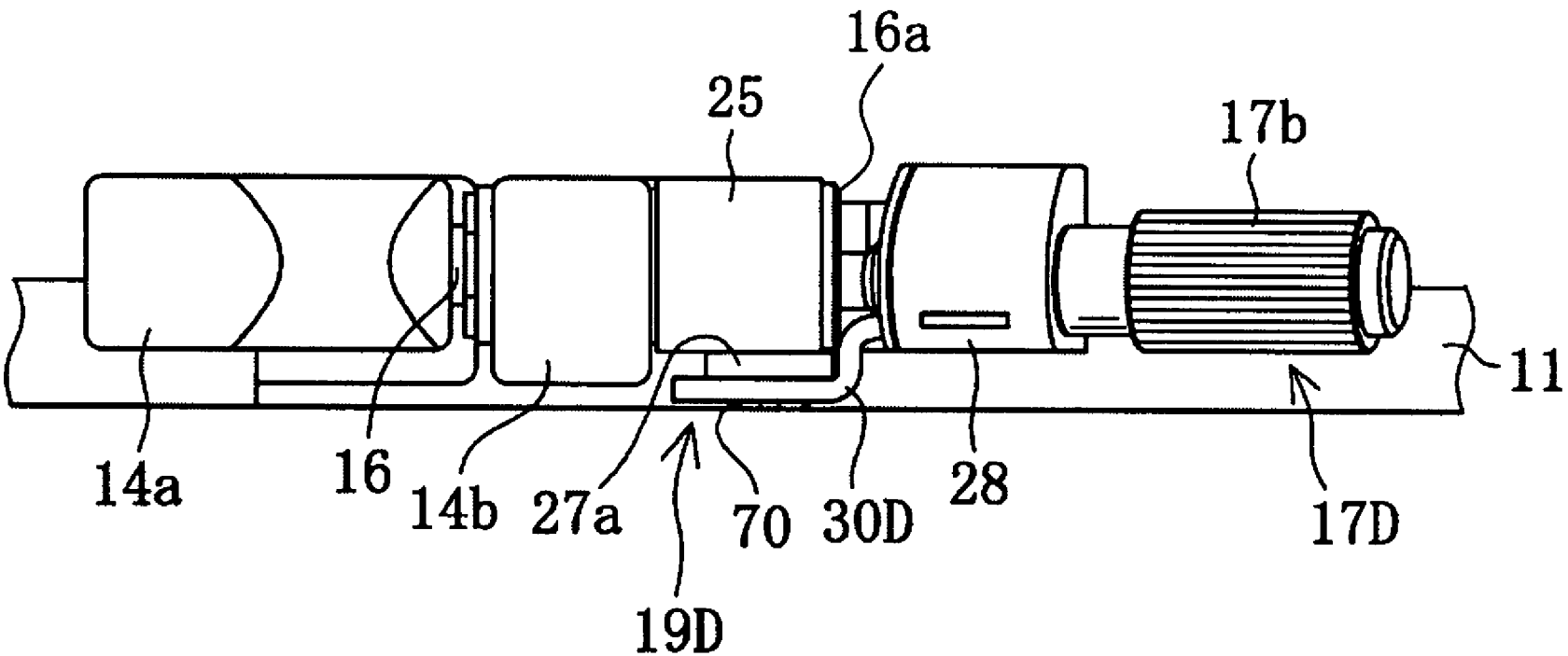
FIG. 27 is a diagram corresponding to FIG. 4.

By referring to FIGS. 26 and 27, described next is a fifth embodiment of the present invention. Herein, any components similar in structure to those in the above embodiments are provided with the same reference numerals, and only different components will be described below.

In a clamping mechanism 15D of the outer subframe 11 of the embroidery frame 3, a pivotal mechanism 19D for pivotally supporting an operation shaft 17D is different. The operation shaft 17D for rotating the adjustment screw 16 is fixed at the position where the angle between its axial center and the axial center of the adjustment screw 16 shows a predetermined value.

A pivot member 27D, a height-different pin 70, and a support arm 30D are similar to those in the fourth embodiment. The operation shaft 17D is fixed at the position equivalent to the first position (initial position) in the first embodiment. That is, the operation shaft 17D is fixed at such a position that the operation shaft 17D is axially parallel to the cloth surface held by the embroidery frame 3, and the operation shaft 17D is tilted toward the direction away from the outer subframe 11.

Such a structure favorably widens the space between the operation shaft 17D and the outer subframe 11, thereby leading to the better workability for operation of the operation shaft 17D. What is more, the operation shaft 17D will be located in the horizontal plane parallel to the cloth surface both at the initial and in-use positions. Accordingly, the operation shaft 17D does not protrude from the embroidery frame 3, and it is considered advantageous in terms of embroidery sewing and storage of the embroidery frame 3.

Described next are modified examples in which the above-described embodiments are partially changed.

1. In the above first embodiment, slits are formed around a coupling hole. As an alternative to such slits, a key groove may be an option. With this being the case, there is no need for a cover sleeve.
2. In the above embodiments, a clamping mechanism is provided to the front side surface of an outer subframe. Alternatively, there is no restriction for placement of the clamping mechanism as long as it is provided to straight portion but not to corner portions of the outer subframe.
3. In the above embodiments, a clamping mechanism provided to an embroidery frame is only one. Alternatively, the clamping mechanism may be provided two or more.
4. It is understood that numerous other modifications and variations can be devised by those in the art from the above embodiments, and the present invention includes the resulting modifications and variations.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. An embroidery frame for holding a cloth, comprising:

an outer subframe with a section that breaks continuity;

an inner subframe that is snapped inside of the outer subframe to hold a cloth with the outer subframe;

a clamp mechanism for clamping the outer subframe against the inner subframe, wherein the clamp mechanism includes a pair of screw attachment sections facing each other at both ends of the continuity-breaking section of the outer frame, an adjustment screw that is attached across the screw attachment sections for adjusting a space between the screw attachment sections, an operation shaft for rotating the adjustment screw that moves in a range from a first position at which the operation shaft is directed in an axial direction same as or different from the adjustment screw, and a second position at which the operation shaft is tilted in a direction increasing a space with the outer subframe, and a coupling mechanism for coupling together the operation shaft and the adjustment screw, and transferring a torque of the operation shaft to the adjustment screw.

2. The embroidery frame according to claim 1, wherein the operation shaft between the first and second positions is axially parallel to a stretched surface of the cloth held by the inner and outer subframes.

3. The embroidery frame according to claim 1, wherein the adjustment screw is axially parallel to a stretched surface of the cloth, and the operation shaft between the first and second positions has, axially, a tilted angle with respect to the stretched surface of the cloth in a range excluding the first position.

4. The embroidery frame according to claim 1, wherein the outer subframe is formed substantially rectangular, and the screw attachment sections are provided at positions other than curved corner portions of the outer subframe.

5. The embroidery frame according to claim 3, wherein the outer subframe is formed substantially rectangular, and the screw attachment sections are provided at positions other than curved corner portions of the outer subframe.

6. The embroidery frame according to claim 4, wherein the positions other than the curved corner portions are straight portions of the outer subframe.

7. The embroidery frame according to claim 5, wherein the positions other than the curved corner portions are straight portions of the outer subframe.

8. The embroidery frame according to claim 1, wherein the adjustment screw is so placed as to be substantially axially parallel to the straight portions of the outer subframe in a length direction.

9. The embroidery frame according to claim 6, wherein the adjustment screw is so placed as to be substantially axially parallel to the straight portions of the outer subframe in a length direction.

10. The embroidery frame according to claim 7, wherein the adjustment screw is so placed as to be substantially axially parallel to the straight portions of the outer subframe in a length direction.

11. The embroidery frame according to claim 1, wherein the coupling mechanism includes:

a coupling hole formed to a head portion of the adjustment screw to receive a tip end portion of the operation shaft with play;

a pair of slits formed around the coupling hole to extend along an axial direction of the adjustment screw; and an engagement pin formed at the tip end portion of the operation shaft to be axially orthogonal, and has both ends engaged with the pair of slits.

12. The embroidery frame according to claim 10, wherein the coupling mechanism includes:

a coupling hole formed to a head portion of the adjustment screw to receive a tip end portion of the operation shaft with play;

a pair of slits formed around the coupling hole to extend along an axial direction of the adjustment screw; and an engagement pin formed at the tip end portion of the operation shaft to be axially orthogonal, and has both ends engaged with the pair of slits.

13. The embroidery frame according to claim 11, wherein the tip end portion of the operation shaft receives the engagement pin to freely move, and the head portion of the adjustment screw is attached with a cover sleeve.

14. The embroidery frame according to claim 12, wherein the tip end portion of the operation shaft receives the engagement pin to freely move, and the head portion of the adjustment screw is attached with a cover sleeve.

15. The embroidery frame according to claim 11, wherein the clamp mechanism has a pivotal mechanism for pivotally supporting the operation shaft to the outer subframe to freely rotate.

16. The embroidery frame according to claim 12, wherein the clamping mechanism has a pivotal mechanism for pivotally supporting the operation shaft to the outer subframe to freely rotate.

17. The embroidery frame according to claim 15, wherein the pivotal mechanism has a stopper section for restricting a movement range of the operation shaft.

18. The embroidery frame according to claim 16, wherein the pivotal mechanism has a stopper section for restricting a movement range of the operation shaft.

19. The embroidery frame according to claim 1, wherein the clamp mechanism has latch means for latching the operation shaft between the first and second positions.

20. The embroidery frame according to claim 14, wherein the clamp mechanism has latch means for latching the operation shaft between the first and second positions.

21. The embroidery frame according to claim 18, wherein the clamp mechanism has latch means for latching the operation shaft between the first and second positions.

22. The embroidery frame according to claim 19, wherein the latch means has a retention member for retaining the operation shaft at an arbitrary position between the first and second positions.

23. The embroidery frame according to claim 20, wherein the latch means has a retention member for retaining the operation shaft at an arbitrary position between the first and second positions.

24. The embroidery frame according to claim 21, wherein the latch means has a retention member for retaining the operation shaft at an arbitrary position between the first and second positions.

25. The embroidery frame according to claim 22, wherein the retention member has a member generating a retention force by frictional resistance.

26. The embroidery frame according to claim 23, wherein the retention member has a member generating a retention force by frictional resistance.

27. The embroidery frame according to claim 24, wherein the retention member has a member generating a retention force by frictional resistance.

28. An embroidery frame for holding a cloth, comprising:

an outer subframe with a section that breaks continuity;

an inner subframe that is snapped inside of the outer subframe to hold a cloth with the outer subframe;

a clamp mechanism for clamping the outer subframe against the inner subframe, wherein the clamp mechanism includes a pair of screw attachment sections facing each other at both ends of the continuity-breaking section of the outer frame, an adjustment screw that is attached across the screw attachment sections for adjusting a space between the screw attachment sections, an operation shaft for rotating the adjustment screw that is so provided that an amplitude between the axial center thereof and the axial center of the adjustment screw shows a predetermined angle, and a coupling mechanism for coupling together the operation shaft and the adjustment screw, and transferring a torque of the operation shaft to the adjustment screw.

29. The embroidery frame according to claim 28, wherein the operation shaft is axially parallel to the stretched surface of the cloth, and a free end side of the operation shaft is tilted in a direction away from the outer subframe.

30. The embroidery frame according to claim 28, wherein the operation shaft forms a tilt angle with the stretched surface of the cloth geld by the embroidery frame, and a free end side of the operation shaft is tilted in a direction away from an upper surface of the outer subframe.

* * * * *